United States Patent [19]

Johansson

[11] 4,141,131

[45] Feb. 27, 1979

[54] APPARATUS AND METHOD FOR BUTTONING GARMENTS

[75] Inventor: Nils L. Johansson, Ganghester, Sweden

[73] Assignee: AB Calator, Boras, Sweden

[21] Appl. No.: 838,027

[22] Filed: Sep. 29, 1977

[30] Foreign Application Priority Data

Sep. 30, 1976 [SE] Sweden ..... 7610895
Aug. 11, 1977 [SE] Sweden ..... 7709073

[51] Int. Cl.[2] ..... A41H 43/00

[52] U.S. Cl. ..... 29/428; 29/281.1; 29/700; 223/1

[58] Field of Search ..... 29/281.1, 283, 428, 29/700, 4; 223/1, 44; 12/58.3

[56] References Cited

U.S. PATENT DOCUMENTS 1,487,732 3/1924 Enslin ..... 12/58.3
3,024,952 3/1962 Friend et al. ..... 223/1

FOREIGN PATENT DOCUMENTS 506384 3/1976 U.S.S.R.

*Primary Examiner*—Michael J. Keenan
*Attorney, Agent, or Firm*—Pollock, Vande Sande & Priddy

[57] ABSTRACT

Apparatus and method for buttoning garments such as shirts including a frame supporting surface which supports the garment to be buttoned, such frame comprising a plurality of pairs of spaced plates for fixedly holding the buttonhole strip of the garment, a plurality of hook-shaped members positioned to extend through the buttonholes into contact with the button strip, a plate adjustably supporting the button strip so as to move the buttons into engagement with the extended hook-shaped members; the hook-shaped members and attached buttons being drawn through corresponding buttonholes, and the hook-shaped members and pairs of plates being disengaged from the buttoned garment.

23 Claims, 19 Drawing Figures

FIG 1
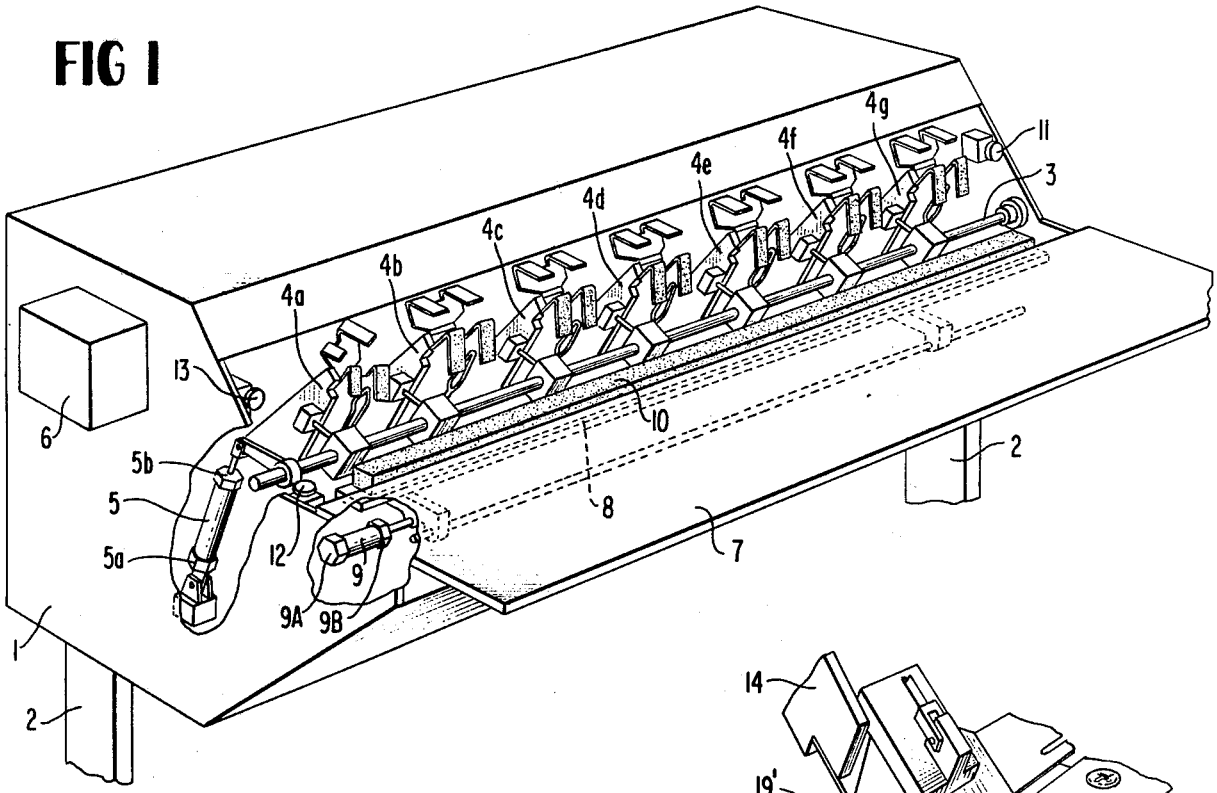
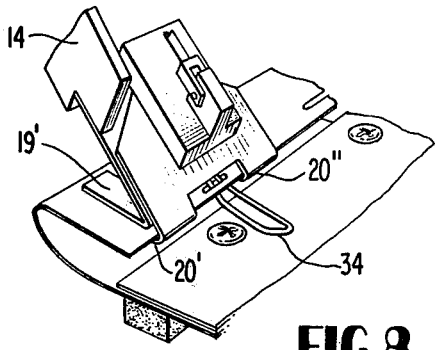
FIG 8
FIG 9
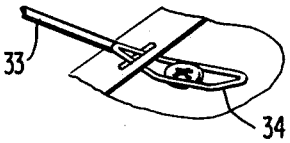
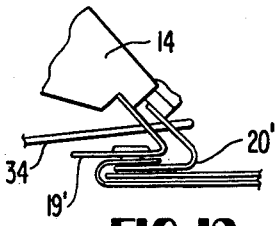
FIG 12
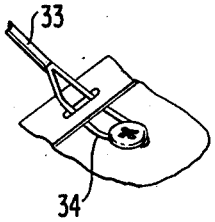
FIG 10
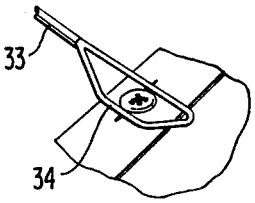
FIG 11
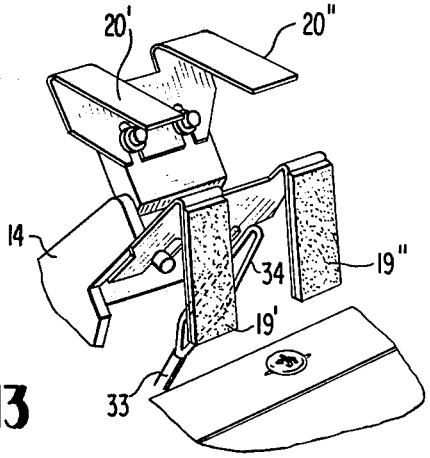
FIG 13

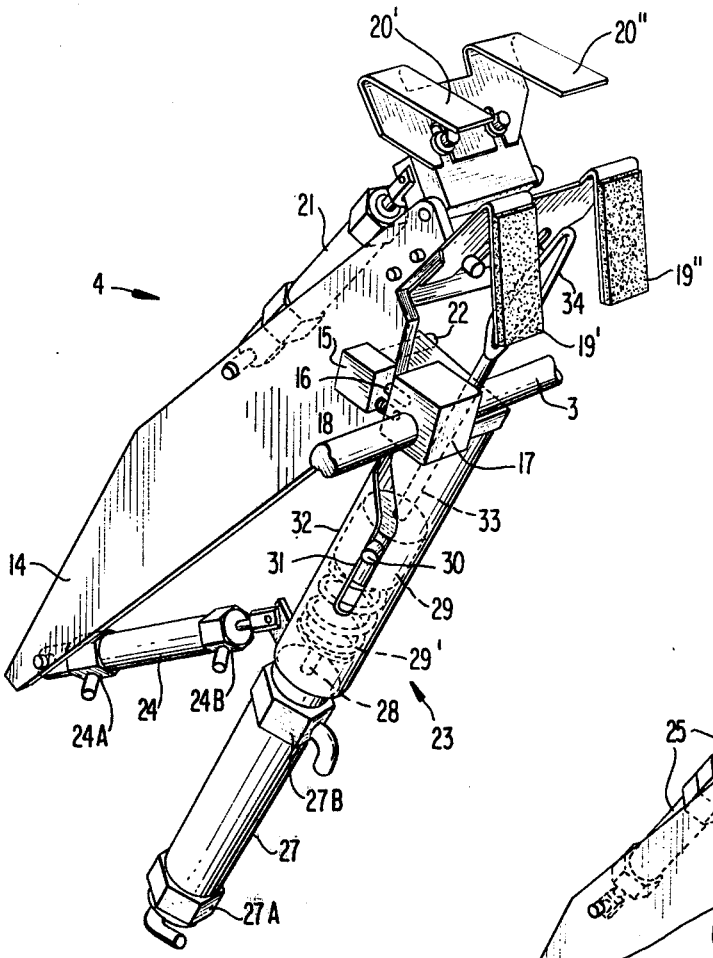
FIG 2
FIG 3
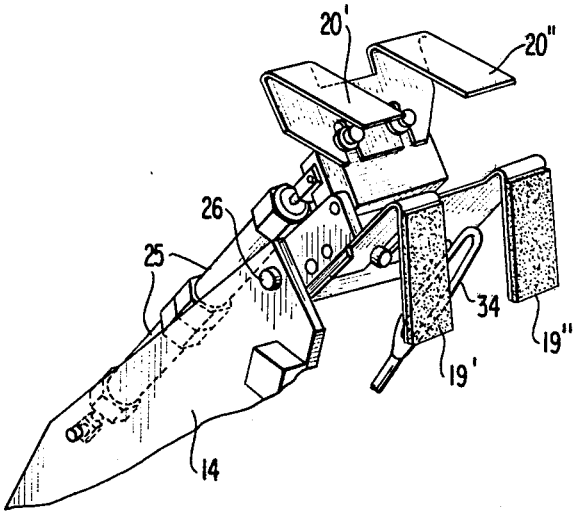
FIG 4A
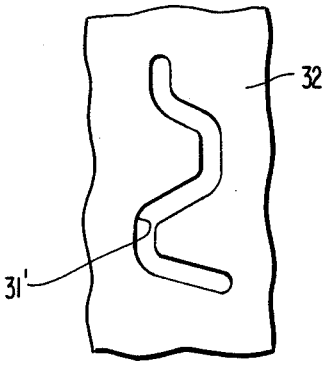
FIG 4B
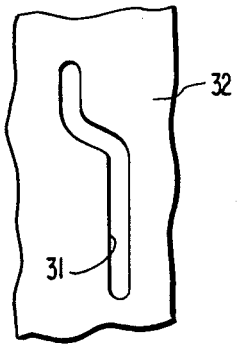

FIG. 14
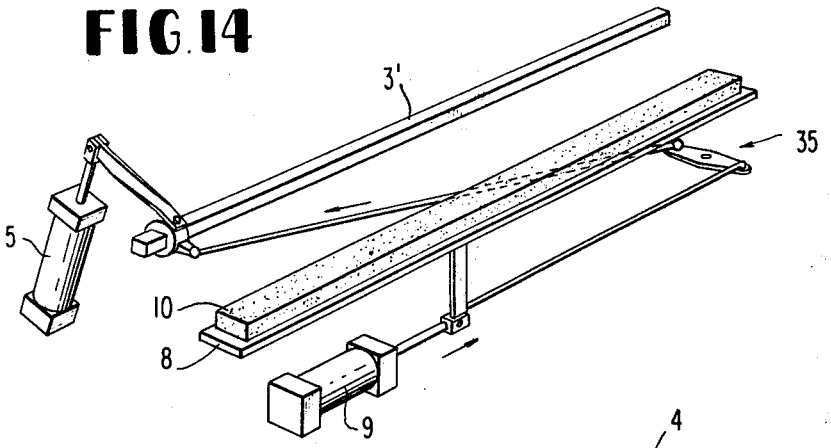
FIG. 15
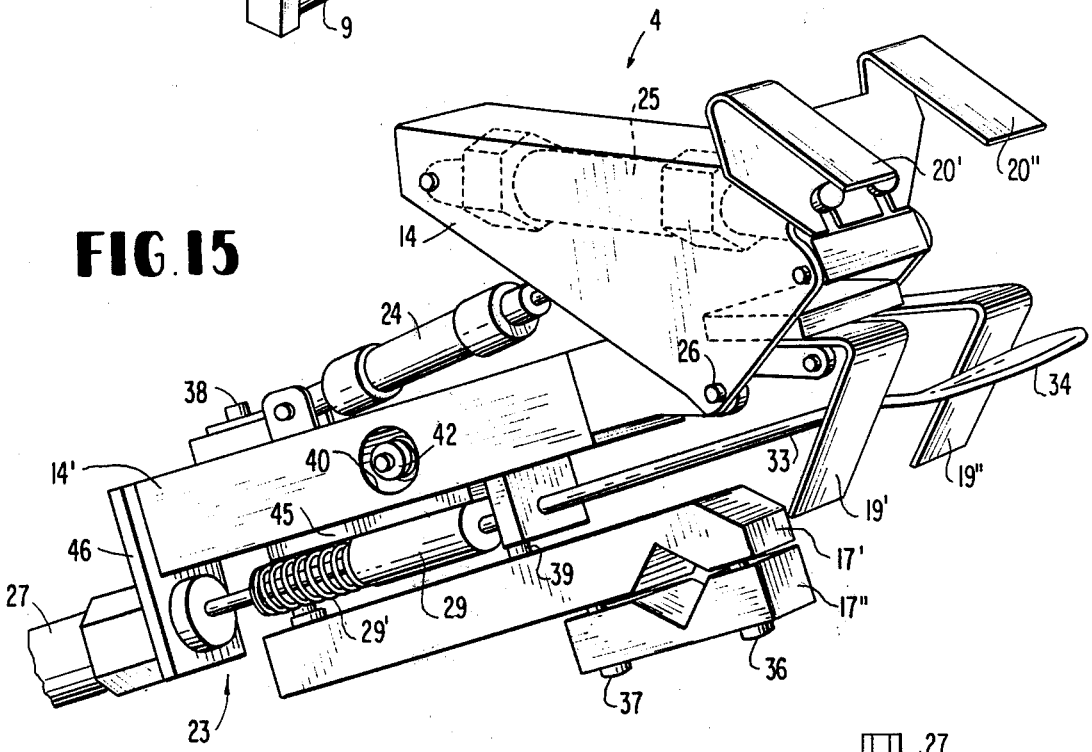
FIG. 15A
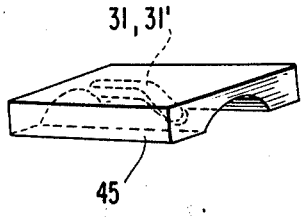
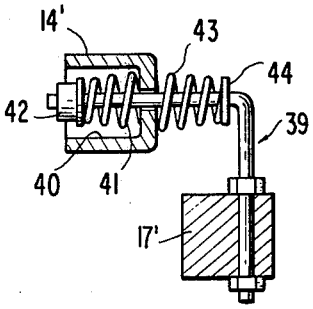
FIG. 15B
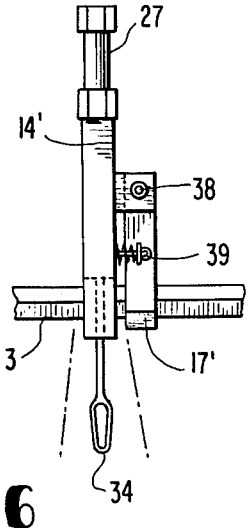
FIG. 16

APPARATUS AND METHOD FOR BUTTONING GARMENTS

BACKGROUND AND OBJECTS OF THE INVENTION

In the manufacture of garments such as shirts, the buttoning, prior to packaging, of a large number of garments involves a significant cost for labor. For this reason, it is highly desirable to be able to provide equipment in a garment manufacturing facility which will rapidly conduct a buttoning operation in a virtually automatic manner with a minimum of labor.

One object of this invention is to provide apparatus which automatically buttons garments. Such apparatus can be adjusted to button any number of buttons and can also be adjusted in accordance with varying spacing of buttons from one garment to another.

Another object of the present invention is to provide apparatus easily controlled by a single operator which is safe and reliable to use.

These objects are given only by way of example. Thus, other desirable objects and advantages inherently achieved by the invention may occur to those skilled in the art.

SUMMARY OF THE INVENTION

The apparatus of the present invention includes a stationary frame with a rigidly attached lay-out table for supporting the garment during the buttoning operation. A plurality of axially adjustable buttoning assemblies are pivotally mounted on a shaft secured in the stationary frame. Each buttoning assembly includes a hook-shaped member extending from a pneumatic cylinder and actuated to pass through the buttonhole and enclose a corresponding button of the garment. A pneumatic control system directs the cylinder to draw the hook and button through the buttonhole, thereby buttoning the garment. A plurality of separate pneumatic cylinders are then actuated to move the hook assembly away from the buttoned garment at the completion of the buttoning operation.

BRIEF DESCRIPTION OF THE DRAWINGS

In describing the invention, reference will be made to the accompanying drawings in which:

FIG. 1 is a perspective view of the preferred embodiment of the apparatus for buttoning a garment according to the present invention;

FIG. 2 shows a particular buttoning system according to the preferred embodiment;

FIG. 3 shows a section of the aforesaid buttoning system in an alternative embodiment;

FIG. 4*a* shows in detail the groove in the buttoning system for the collar button of a shirt or the like;

FIG. 4*b* shows the same groove in the buttoning system for the remaining buttons of the garment;

FIGS. 5–13 show diverse phases of operation and working positions of an individual buttoning system and its hook assembly from the initial lay-out of the garment on the apparatus through the buttoning of the garment to the final phase of removing the garment from the buttoning apparatus;

FIG. 14 shows a detailed view of a buttonhole strip alignment assembly according to a further embodiment of the present invention;

FIG. 15 shows a particular buttoning system according to the embodiment of FIG. 14;

FIG. 15*a* shows a detailed view of the detachably connected groove plate according to the embodiment of FIG. 15;

FIG. 15*b* shows a detailed view of the pivotal support assembly according to the embodiment of FIG. 15; and FIG. 16 shows a top view of the possible pivotal movement of the buttoning system according to the embodiment of FIG. 15.

DETAILED DESCRIPTION OF THE PREFERRED EMBODIMENT

Figure 5:
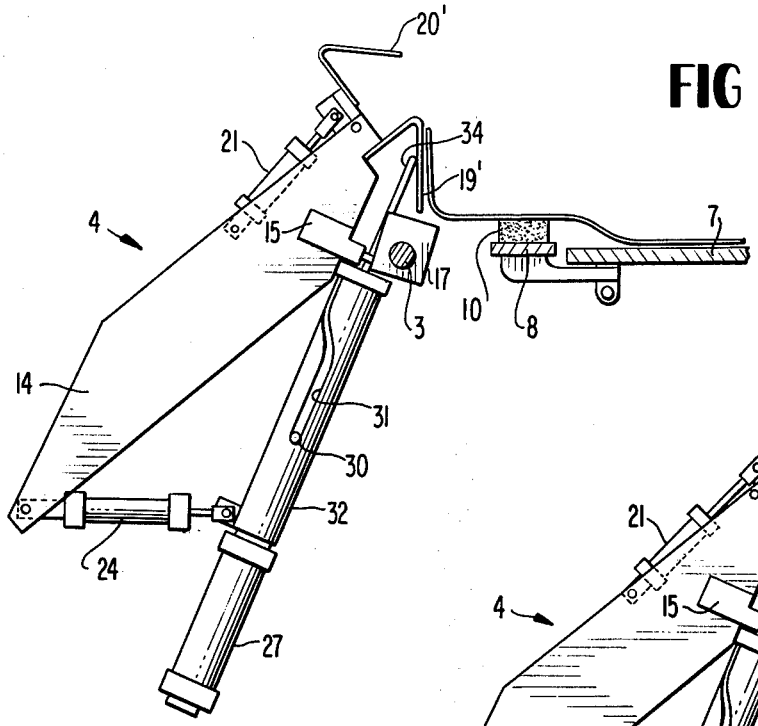

With reference to FIGS. 1–4, the apparatus according to the present invention is provided with a stand 1 which includes support legs 2. A shaft 3 is rotatably journalled in stand 1. A plurality of buttoning assemblies 4*a*–4*g* are axially adjustable along shaft 3 for alignment with the buttonholes of the garment to be buttoned. Each of the buttoning assemblies 4*a*–4*g* is rotatably attached to shaft 3. Shaft 3 is rotated by a pressurized fluid cylinder 5 with ends 5*a* and 5*b* which are selectively actuated by control unit 6 comprising intrinsically conventional components that are connected to a conventional pressurized fluid source.

As shown in FIG. 1, a lay-out table 7 which supports the garment to be buttoned is rigidly attached to stand 1. A rectangular plate 8, located between lay-out table 7 and stand 1, is constrained to reciprocate axially with respect to shaft 3 and is actuated by means of a pressurized fluid cylinder 9 with ends 9*a* and 9*b*, and mounted in stand 1. Plate 8 is covered with a brush-like surface 10 which supports the button strip portion of the garment in a non-slip manner during the buttoning operation. Control button 11 is mounted at the opposite end of stand 1 from cylinder 9. Further control buttons 12 and 13 are mounted on the stand adjacent cylinder 9. The exact functions of control buttons 11, 12 and 13 will become readily apparent from a description of the apparatus which follows.

Each buttoning assembly 4*a*–4*g* comprises a frame 14 rigidly attached to a mounting member 15. A shaft 16 extending from mounting member 15 is rotatably journalled in a second mounting member 17 which is both rotatably attached to, and axially movable along, shaft 3. A spring 18 is positioned between mounting members 15 and 17, whereby frame 14 and its attached mounting member 15 can rotate against the influence of spring 18 relative to mounting member 17.

Two plates 19′ and 19″ mounted at the end of frame 14 have their uppermost surfaces formed of rubber or a similar high-frictional material. Two plates 20′ and 20″ are pivotally mounted on frame 14. A pressurized fluid cylinder 21, attached between frame 14 and plates 20′ and 20″ functions to pivot plates 20′ and 20″ into contact with plates 19′ and 19″ to clamp the buttonhole portion of the garment. A shaft 22 supports a cylinder device 23 for rotation relative to frame 14 under the influence of a pressurized fluid cylinder 24 which has ends 24*a* and 24*b*.

FIG. 3 shows an alternative embodiment in which cylinders 21 and 24 have been replaced by a two-stage pressurized fluid cylinder 25 which first moves plates 20′ and 20″ to bear against plates 19′ and 19″ and thereafter rotates the entire arrangement of plates about shaft 26 attached to frame 14. In this embodiment, cylinder device 23 is also rigidly attached to frame 14.

Cylinder device 23 includes a pressurized fluid cylinder 27 with ends 27*a* and 27*b*. A piston rod 28 extends from cylinder 27 to a piston 29, such that piston 29 can rotate but is permanently journalled in the longitudinal direction of cylinder 23. A spring 29' is compressed between cylinder 27 and piston 29. Piston 29 further includes a steering pin or cam member 30 which extends into a groove 31 located in a cylinder 32 enclosing piston rod 28 and piston 29 and fixed to cylinder 27. A stem 33 of piston 29 extends through the end of cylinder 32 and is attached to a hook-shaped member 34.

The hook member is of a generally planar configuration including an aperture formed with a narrower portion than the diameter of the button adjacent the closed end of said hook member, and a portion of the aperture spaced from the end of the hook which is wider than the diameter of the button, thereby allowing the hook to enclose the button at the wider portion of the aperture. As the hook is withdrawn, the narrow portion of the aperture engages and draws the button through the buttonhole.

The unique arrangement of piston 29, cam 30, and groove 31 results in the hook 34 being simultaneously extended axially and rotated under the influence of cylinder 27.

It has been determined that the offset position of the collar button in a shirt requires the particular hook 34 which passes through the collar buttonhole to follow a path somewhat different from the paths of the remaining hooks 34. This is accomplished by giving the groove 31' of the collar button a shape in accordance with FIG. 4*a*, as compared with FIG. 4*b*, which shows a groove 31 suitable in shape for the remaining hooks 34.

The operation of the apparatus will now be explained in detail. The operator first lays the garment to be buttoned onto lay-out table 7 with the back section of the garment against the table's surface. In this initial position of operation, the side of cylinder 27*b* is pressurized by means of a connection line extending from the control unit 6 to cylinder 27. As to the buttoning system of the collar button, the vented end 27*b* of cylinder 27 allows its hook 34 to move to the extended position under the influence of spring 29'. The only exception is the collar button buttoning system wherein end 27*b* of cylinder 27 is initially vented. This results in the hook 34 in each of the remaining assemblies 4*b*–4*g* being in its retracted position. This allows the operator to extend the hook 34 manually through the buttonhole of the collar button. This, in turn, gives the operator a reference point for stretching out that portion of the garment including the buttonholes against rubber plates 19' and 19". The adjustability of the individual buttoning systems 4*a*–4*g* allows the operator to align each buttoning system with a particular buttonhole of the garment.

Figure 6:
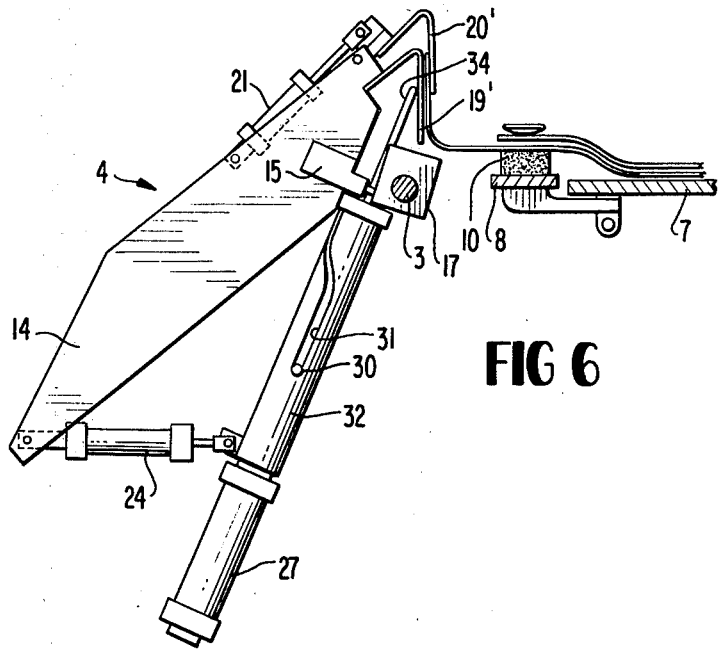

As the operator stretches the buttonhole strip against plates 19' and 19", he simultaneously presses control button 11 which pressurizes cylinder 21, causing plates 20' and 20" to pivot against plates 19' and 19" which clamps the buttonhole strip between the pairs of plates as shown in FIG. 6. If the buttonholes are not aligned between the pairs of plates, the operator may depress control button 13 which vents cylinder 21, allowing the return spring to pivot plates 20' and 20" away from plates 19' and 19". The operator may then adjust the position of the individual buttoning systems with respect to the buttonholes before again depressing control button 11.

The operator next places that portion of the garment including the buttons onto the brush-like surface 10 of plate 8 with the buttons slightly offset in the direction of cylinder 9 from their respective mating buttonholes. The operator next depresses control button 12, whereby control system 6 automatically executes the remainder of the buttoning operation.

Pressurized fluid is supplied to the end 27*a* of cylinder 27 which forces piston rod 28 to push piston 29, its attached stem 33, and hook 34 away from the cylinder 27. This results in hook 34 being moved through the buttonhole. During the movement of hook 34 through the buttonhole, each hook 34 is also rotated due to the movement of stem 33 in groove 31. This results in the plane of hook 34 being at an angle with the plane of lay-out table 7 when hook 34 is in its extended position thus allowing each hook 34 to grasp an individual button during the next step of the buttoning operation.

Figure 7:
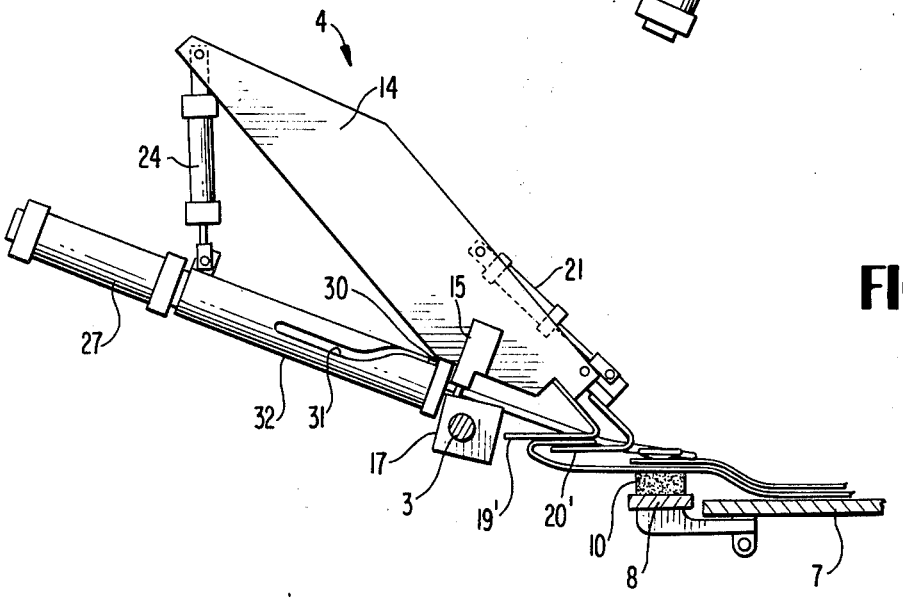

Simultaneously with the movement of hooks 34, control unit 6 supplies pressurized fluid to side 5*a* of cylinder 5 which rotates shaft 3 and all of the buttoning systems 4*a*–4*g* to the approximate position shown in FIG. 7, wherein a side of hook 34 of each buttoning system 4*a*–4*g* rests lightly against that portion of the garment mounted on brush-like surface 10.

Control unit 6 next automatically applies pressure to side 9*a* of cylinder 9 which axially moves plate 8 and brush-like surface 10 such that each button is guided beneath the widest portion of its respective hook 34 and into contact with the side of hook 34 resting against the button strip as shown in FIG. 9.

Control unit 6 next automatically applies pressure to side 27*b* of each cylinder 27 which pulls piston rod 28, attached piston 29 and hook 34 to its retracted position. Due to the engagement of stem 33 and groove 31, each hook 34 is simultaneously rotated during the retraction. This results in the widest portion of hook 34 enclosing the button, and as the hook is withdrawn, the narrow portion of the hook engages and draws the button through the buttonhole.

Side 27*b* of cylinder 27 is now vented which allows hook 34, under the influence of spring 29, to move toward its extended position as shown in FIG. 11. The widest portion hook 34 again encircles the button. Control unit 6 next applies pressure to the 24*a* side of cylinder 24 which pivots each of the entire cylinder devices 23 about its shaft 22 which disengages hook 34 from contact with the individual button as shown in FIG. 12. Fluid pressure is next applied to side 5*b* of cylinder 5 which rotates shaft 3 and each of the buttoning system 4*a*–4*g* back to their original positions shown in FIG. 6. Simultaneously, individual cylinders 21 are vented allowing their return springs to pivot plates 20' and 20" back to their original positions as shown in FIGS. 2 and 5, respectively, releasing the buttoned shirt from the buttoning apparatus.

Control unit 6 next applies pressure to side 9*b* of cylinder 9 which moves plate 8 back to its initial position. Pressure is also applied to side 24*b* of cylinders 24 and side 27*b* of cylinders 27 which move cylinders 23 and hooks 34, respectively, back to their original positions. With respect to the collar button, cylinder 27 is vented to allow hook 34 to remain in the partially extended position under the influence of spring 29'.

A further embodiment of this invention is shown in FIGS. 14–16. Elements which have been modified from the preceding embodiments are indicated with a prime (').

Referring to FIG. 14, a shaft 3' of rectangular cross-section is mounted for both translation and rotation. Cylinder 9 actuates linkage 35 connected to cylinder 9 and shaft 3' which simultaneously translates shaft 3' and plate 8 in opposite directions to reduce by one-half the distance plate 8 must traverse to align the buttons with their corresponding button assemblies 4. It is necessary to connect cylinder 5 to shaft 3' by an articulated linkage which pivots as shaft 3' translates and is capable of rotating shaft 3' during the buttoning operation.

As shown in FIGS. 14, 15*a–b*, and 16, a two-part fastener 17', 17" is substituted for the single fastener 17 of the previously described embodiments, with the parts 17' and 17" being positioned on opposite sides of shaft 3' and pressingly connected to shaft 3' by screws 36 and 37.

Fastener 17' extends parallel to and is axially offset from buttoning unit 4. A hollow frame member 14' supports cylinder 23 and is pivotally connected to fastener 17' by shaft 38. A further L-shaped shaft 39 positioned between shaft 38 and shaft 3' is attached at one end to fastener 17' with the opposite end extending through a bore 40 formed in the side wall of hollow frame 14'.

A first compression coil spring 41 is positioned within frame 14' between a first stop 42 on the shaft 39 and an inside wall of frame 14'. A second compression coil spring 43 is positioned between a second stop 44 on shaft 39 and an outside wall of frame 14'. The buttoning unit 4 pivots about shaft 38 with springs 41 and 43 cushioning the pivotal movement of unit 4.

Because of the pivotal connection, the buttoning shaft 33 can pivot during the buttoning operation to adjust for irregularly positioned buttonholes without the necessity of axially resetting the buttoning unit 4 along shaft 3'.

In a further modification, tube 32 is replaced with a plate 45 which is detachably connected to frame 14' and is positioned between frame 14' and cylinder 23. Plate 45 includes integrally formed groove 31 or 31'. Because plate 45 is detachable, a worn groove 31 or 31' can be replaced without dismantling the buttoning unit 4 by merely removing plate 45 with the worn groove and inserting a new plate 45.

The cylinder 24 is attached to frames 14 and 14' with the frame 14 being pivotal about shaft 26 to rotate plates 20' and 20" into abutting relationship with plates 19' and 19". Frame 14' is connected to cylinder 27 through a plate member 46.

As a further modification, buttoning shaft 33 may be formed with loop 34 slightly displaced toward shaft 3' which presses loop 34 into contact with covering 10 to ensure proper engagement of loop 34 and the button during the buttoning operation.

The embodiments described in the foregoing specification and shown in the accompanying drawings are to be regarded as non-limiting examples which can be altered and completed in any way within the scope of the invention.

Having described my invention in sufficient detail to enable those skilled in the art to make and use it, I claim:

1. Apparatus for automatically buttoning a garment such as a shirt comprising:

retaining means for retaining the bottonhole strip of the garment in a fixed position during the buttoning operation;

support means for supporting the button strip of the garment relative to the buttonhole strip, at least one hook means associated with a respective button and buttonhole, insert means for inserting said at least one hook means through the buttonhole into engagement with the button, and means for rotating said hook means into position surrounding the button and for withdrawing said hook means and the button engaged thereby through the buttonhole.

2. Apparatus as set forth in claim 1 wherein said retaining means comprises:

first and second pairs of spaced plates;

said first pair of spaced plates being rigidly attached to a support assembly rotatively mounted in the apparatus;

said second pair of spaced plates being pivotally mounted on said support member relative to said first pair of plates;

means for pivoting said second pair of plates into abutting relationship with said first pair of plates to retain the buttonhole strip of the garment in a fixed position therebetween.

3. Apparatus as set forth in claim 2 wherein that portion of the first pair of plates which contacts the buttonhole strip of the garment is covered with a high-friction material to prevent slippage of the retained buttonhole strip from its fixed position during the buttoning operation.

4. Apparatus as set forth in claim 2 wherein said means for pivoting said second pair of plates comprises a pressurized fluid cylinder which is selectively actuated to pivot said second plates into contact with said first plates.

5. Apparatus as set forth in claim 4 wherein said means for pivoting said second plates further comprises a spring positioned to pivot said second pair of plates away from said first pair of plates after said pressurized fluid is vented from said cylinder.

6. Apparatus as set forth in claim 1 wherein said supporting means comprises:

a support surface for supporting the garment during the buttoning operation;

a support member adjustably attached to said support surface for supporting the button strip of the garment during the buttoning operation;

actuable means positioned to adjustably move said member and the button strip supported thereon relative to the fixed buttonhole strip.

7. Apparatus as set forth in claim 6 wherein said support member comprises a rectangular plate positioned for axial movement relative to said support surface;

said support member further comprising a brush-like surface contacting the button strip of the garment to prevent slippage of the button strip relative to the support member.

8. Apparatus as set forth in claim 6 wherein said actuable means comprises a pressurized fluid selectively actuated to move said support member and button strip relative to said fixed buttonhole strip, said cylinder being further actuable to return the support member to its initial position upon completion of the buttoning operation.

9. Apparatus according to claim 8 wherein said actuable means is further connected to said retaining means to simultaneously move said button strip and said buttonhole strip in opposite axial directions to align each button with its corresponding buttonhole.

10. Apparatus as set forth in claim 1 wherein said insert means comprises a pressurized fluid cylinder which includes a rod extending thereform and attached to a control means, said control means being selectively actuable to move said hook means through the buttonhole for engagement with the button and thereafter withdrawing said rod, the attached hook means and the engaged button through the buttonhole.

11. Apparatus as set forth in claim 1 wherein said hook means comprises a hook-shaped member supported by a control means for the simultaneous rotational and axial movement of said hook-shaped member.

12. Apparatus as set forth in claim 11 wherein said control means comprises a hollow cylinder which slidably encloses a plate that is rigidly attached on a first side with said hook-shaped member and rigidly attached on a second side with said insert means, wherein said insert means forces said plate to move through said hollow cylinder extending said hook-shaped member through the buttonhole.

13. Apparatus according to claim 10 wherein said control means comprises a hollow frame which slidably supports a plate that is rigidly attached on a first side with a hook-shaped member and rigidly attached on a second side with said insert means, wherein said insert means forces said plate to slide axially with respect to said hollow frame to extend said hook-shaped member through the buttonhole.

14. Apparatus as set forth in claim 13 wherein a cam plate with a groove formed in the surface is detachably connected to said hollow frame and positioned to guide a cam member attached to said plate;

said control means being actuated to cause rotation of said plate and said hook means attached thereto simultaneously with the axial movement of said hook means through the buttonhole.

15. Apparatus according to claim 13 wherein said hollow frame and said slidably supported hook means are mounted in pivotal relationship to said buttonhole strip to allow said hook means to pivotally align with an irregularly positioned buttonhole.

16. Apparatus according to claim 12 wherein a connection assembly rotatively couples said hollow cylinder to a first shaft journalled in said apparatus, a pressurized fluid cylinder being provided to rotate said first shaft and said hollow cylinder to align the hook-shaped member for engagement with the button strip after passing through the buttonhole.

17. Apparatus as set forth in claim 16 wherein said connection assembly further couples said hollow cylinder to a second shaft positioned parallel to said first shaft and extending from a support member mounted on said first shaft, a separate pressurized fluid cylinder being attached to said support member and said hollow cylinder to rotate said cylinder about said second shaft, thereby disengaging the hook-shaped member from the buttoned garment.

18. Apparatus as set forth in claim 17 wherein said hook means comprises a plurality of hook-shaped members corresponding to the number of buttonholes and buttons on the garment and axially adjustable along said first shaft to align with the buttonholes.

19. Apparatus as set forth in claim 14 wherein said groove in the hollow cylinder of the collar button hook means is formed with a shape different from the shape of said groove associated with the remaining hook means, to adjust for the offset position of the collar buttonhole and button.

20. Apparatus as set forth in claim 1, in which:

said hook means comprises a generally planar hook member having a narrow end portion for insertion into the buttonhole and a broader portion remote from said end portion, but which is sufficiently narrow to pass through the buttonhole of the garment;

said hook member having an aperture which is narrower than the diameter of the button at its narrowest portion, and wider than the diameter of the button at its widest portion;

said insert means including control means for translationally moving said hook member through the buttonhole to a predetermined position wherein the widest portion of said aperture is adjacent the button;

said control means holding said planar hook member at an angle to the plane of the button when said hook member is moved through the buttonhole to said predetermined position;

further means for moving said hook member together with said buttonhole strip relative to said button strip in a direction to cause a peripheral edge of the aperture in said hook member at the widest portion of said aperture to underlie the button;

said control means rotating said hook member to a co-planar position relative to the button to surround the button, after said further means has brought the button and hook member into the above-described position in which said peripheral edge underlies the button, said control means retracting said hook to bring the narrow portion of said aperture into engagement with the button, after which the control means draws both the hook member and engaged button through the buttonhole;

said control means thereafter moving said hook member to a position where the widest portion of said aperture surrounds the button, said control means thereafter disengages said hook member from the button garment.

21. Apparatus for automatically buttoning garments such as shirts, comprising:

a stationary frame;

a shaft rotatively supported in said frame including a plurality of spaced buttoning assembly means mounted for both rotation with said shaft and axial adjustment along said shaft;

a first pair of spaced plates rigidly attached to each of said buttoning assembly means and a second pair of spaced plates pivotally attached to each of said buttoning assembly means;

means for pivotally moving said second pair of plates into abutting relationship with said first pair of plates of each buttoning assembly means to clamp the buttonhole strip of said garment therebetween;

a horizontal surface rigidly attached to said frame for supporting the garment during the buttoning operation including a separate portion supporting the button strip of the garment while being axially reciprocal with respect to said frame;

means for reciprocating said separate portion of the surface and the button strip of the garment positioned thereon during the buttoning operation to bring the individual garment buttons into contact with said buttoning assembly means;

control means positioned on said frame to initiate the automatic buttoning operation;

and means responsive to the control means for moving said buttoning assembly means through the buttonholes of the clamped buttonhole strip and into contact with said buttons of the button strip, said further means then causing the buttoning assembly means and attached buttons to be drawn through the buttonholes to button the garment and said responsive means moving said buttoning assembly means out of contact with the buttoned garment upon completion of the buttoning operation.

22. A method of automatically buttoning a garment such as a shirt comprising the steps of:

(a) retaining the buttonhole strip of the garment in a fixed position during the buttoning operation;

(b) extending a hook-shaped member through said retained buttonholes to engage with the button strip which is supported on a support plate adjustably attached to the apparatus;

(c) bringing said support plate and said button strip into contact with the extended hook-shaped member;

(d) rotating said extended hook-shaped member into a position surrounding the button;

(e) drawing the hook-shaped member and attached button through the buttonhole; and (f) disengaging the hook-shaped member from the buttoned garment.

23. Apparatus for automatically buttoning a garment such as a shirt comprising:

retaining means for retaining the buttonhole strip of the garment in a fixed position during the buttoning operation;

support means for supporting the button strip of the garment relative to the buttonhole strip;

at least one hook means associated with a respective button and buttonhole;

insert means for inserting said at least one hook means through the buttonhole into engagement with the button, means for withdrawing said hook means and the button engaged thereby through the buttonhole;

said retaining means comprising:

first and second pairs of spaced plates;

said first pair of spaced plates being attached to a support assembly rotatively mounted in the apparatus;

at least said second pair of spaced plates being pitotally mounted on said support member relative to said first pair of plates;

means for pivoting said second pair of plates into abutting relationship with said first pair of plates to retain the buttonhole strip of the garment in a fixed position therebetween.

* * * * *